US010435266B2

(12) United States Patent
Xiao et al.

(10) Patent No.: US 10,435,266 B2
(45) Date of Patent: Oct. 8, 2019

(54) AUTOMATIC MESH REELING MACHINE

(71) Applicant: Qinhuangdao xinyue intelligent equipment Co., Ltd., Qinhuangdao (CN)

(72) Inventors: Guoxin Xiao, Qinhuangdao (CN); Taotao Liu, Qinhuangdao (CN); Chong Li, Qinhuangdao (CN); Yan Sun, Qinhuangdao (CN)

(73) Assignee: QINHUANGDAO XINYUE INTELLIGENT EQUIPMENT CO., LTD., Qinhuangdao, Hebei (CN)

( * ) Notice: Subject to any disclaimer, the term of this patent is extended or adjusted under 35 U.S.C. 154(b) by 228 days.

(21) Appl. No.: 15/619,756

(22) Filed: Jun. 12, 2017

(65) Prior Publication Data

US 2018/0282095 A1 Oct. 4, 2018

(30) Foreign Application Priority Data

Mar. 31, 2017 (CN) ..... 2017 1 0207334

(51) Int. Cl.
*B65H 26/06* (2006.01)
*B65H 35/00* (2006.01)

(52) U.S. Cl.
CPC ..... *B65H 35/008* (2013.01); *B65H 26/06* (2013.01); *B65H 2511/114* (2013.01)

(58) Field of Classification Search
CPC ..... B26D 7/06; B26D 5/00; B65H 35/008; B65H 26/06; B65H 2511/114
See application file for complete search history.

(56) References Cited

U.S. PATENT DOCUMENTS 6,350,962 B1 * 2/2002 Beltrandi ..... B26D 7/01 219/121.68
2009/0038455 A1 * 2/2009 Strong ..... B23D 47/045 83/155.1
2015/0292154 A1 * 10/2015 Zheng ..... D21J 5/00 162/226
2018/0071828 A1 * 3/2018 Sun ..... B23B 5/28

* cited by examiner

*Primary Examiner* — Sang K Kim
(74) *Attorney, Agent, or Firm* — Syncoda LLC; Feng Ma

(57) ABSTRACT

An automatic mesh reeling machine includes a manual fiber loading mesh disc mechanism, a quantitative fiber mesh conveying mechanism, a fiber mesh cutting mechanism, an automatic mesh reeling mechanism of left and right mesh reeling hands, an automatic fiber mesh drum delivery mechanism and an automatic mesh stapling mechanism of a mesh stapler. Information about replacing a mesh disc can be transmitted under the cooperation of a mesh pressing rod and a micro switch. A servo motor drives a metering roll to realize fixed length feeding of a mesh. A cutter cylinder drives a blade to cut the fixed length mesh. A left mesh reeling hand and a right mesh reeling hand reel the mesh into a closed mesh drum. A sliding table cylinder, pneumatic parallel clamping jaws and an electric servo cylinder move the fiber mesh drum to a specified position.

1 Claim, 16 Drawing Sheets

AUTOMATIC MESH REELING MACHINE

CROSS-REFERENCE TO RELATED APPLICATIONS

This application is filed based upon and claims priority to Chinese Patent Application No. 201710207334.X, filed on Mar. 31, 2017, the entire contents of which are incorporated herein by reference.

BACKGROUND

The fiber filter screen is an indispensable accessory for an aluminum alloy hub low-pressure casting machine. At present, the fiber filter screen is customized by using an artificial reel. The artificial customized fiber filter screen is large in dimension difference, low in production efficiency and high in labor intensity.

SUMMARY

The disclosure relates to a fiber filter screen manufacturing process.

A device for automatically producing reeled meshes is provided.

An automatic mesh reeling machine includes a manual fiber loading mesh disc mechanism, a quantitative fiber mesh conveying mechanism, a fiber mesh cutting mechanism, an automatic mesh reeling mechanism of left and right mesh reeling hands, an automatic fiber mesh drum delivery mechanism and an automatic mesh stapling mechanism of a mesh stapler.

The manual fiber loading mesh disc mechanism includes a mesh disc support, a micro switch, a mesh disc, a guide wheel shaft, a guide wheel, a mesh pressing shaft, a mesh pressing rod, a mesh disc core and a mesh disc shaft.

The mesh pressing shaft, the mesh disc shaft, the guide wheel shaft and the micro switch are installed on the mesh disc support respectively. The guide wheel rotates freely around the guide wheel shaft; the mesh disc is installed on the mesh disc core, and the mesh disc core can rotate freely around the mesh disc shaft; and a mesh goes round the guide wheel and is conveyed to the quantitative fiber mesh conveying mechanism. One end of the mesh pressing rod can rotate freely around the mesh pressing shaft, and the other end presses the mesh disc to prevent the mesh from loosening. When the diameter of the mesh disc is reduced, the mesh pressing rod swings clockwise, the mesh pressing rod contacts the micro switch in the absence of the mesh, and information about replacing the mesh disc is transmitted via an electrical signal.

The quantitative fiber mesh conveying mechanism includes a servo motor, a metering roll, a lower supporting wheel, spring pins, a supporting wheel rack, a supporting wheel shaft, a servo motor support, a left guide plate, a right guide plate and a supporting plate.

The servo motor is connected with the metering roll and the servo motor support; the lower supporting wheel, the spring pins, the supporting wheel shaft and the supporting wheel rack are connected with each other; the left guide plate and the right guide plate are connected with the supporting plate respectively. The lower supporting wheel moves up and down along the supporting wheel rack under the action of elasticity of the spring pins; the mesh penetrates through guide grooves below the left guide plate and the right guide plate; the mesh is sandwiched between the metering roll and the lower supporting wheel; the metering roll is driven by the servo motor to rotate intermittently, and the rotating angle of the metering roll is controlled electrically to realize fixed length feeding of the mesh.

The fiber mesh cutting mechanism includes a blade, a cutter holder, a cutter cylinder and a cylinder seat.

The blade is fixed on the cutter holder; the cutter cylinder is a standard cylinder with a guide rod, and the cutter holder is fixed on a piston rod of the cutter cylinder; and the cutter cylinder is connected with the cylinder seat. The blade cuts the mesh under the control of an electromagnetic valve of the cutter cylinder; and an operator adjusts the position of the cutter cylinder on the cylinder seat to reel the mesh having a required length.

The automatic mesh reeling mechanism of left and right mesh reeling hands includes a mesh reeling mandrel, a left mesh reeling hand, a gear, a right mesh reeling hand, a gear, a pneumatic sliding table A, a pneumatic sliding table B, a mandrel seat, a rack A, a rack B, a mesh ejecting hand and a mesh ejecting cylinder.

The mesh reeling mandrel, the pneumatic sliding table A, the pneumatic sliding table B and the mesh ejecting cylinder are fixed on the mandrel seat; the left mesh reeling hand, the right mesh reeling hand, the gear and the gear are sleeved on the mesh reeling mandrel. The mesh reeling mandrel is a fixed shaft. The gear is connected with the left mesh reeling hand, a piston of the pneumatic sliding table A drives the rack B to move up and down, and the up-down movement of the rack B drives the gear and the left mesh reeling hand to rotate intermittently around the mesh reeling mandrel; the gear is connected with the right mesh reeling hand, a piston of the pneumatic sliding table B drives the rack A to move up and down, and the up-down movement of the rack A drives the gear and the right mesh reeling hand to rotate intermittently around the mesh reeling mandrel; and a piston of the mesh ejecting cylinder drives the mesh ejecting hand to move up and down.

The fixed length mesh conveyed by the quantitative conveying mechanism stops between the mesh ejecting hand and the mesh reeling mandrel, the left mesh reeling hand reels the left mesh, the right mesh reeling hand reels the right mesh, a mesh drum sleeved on the mesh reeling mandrel is thus formed.

The automatic fiber mesh drum delivery mechanism includes a discharge seat, an electric servo cylinder, a sliding table cylinder, pneumatic parallel clamping jaws and grippers.

The electric servo cylinder is fixed on the discharge seat, the sliding table cylinder is fixed on a sliding block of the electric servo cylinder, the pneumatic parallel clamping jaws are fixed on a piston of the sliding table cylinder, and the grippers are fixed on a sliding block of the pneumatic parallel clamping jaws. When the pneumatic parallel clamping jaws are opened, the lower position of the sliding table cylinder is an original position of the automatic fiber mesh drum delivery mechanism.

When the automatic mesh reeling mechanism reels out the mesh drum, the sliding table cylinder moves to the upper position, the pneumatic parallel clamping jaws are closed to clamp the fiber mesh drum, and the electric servo cylinder simultaneously drives its sliding block carrying the fiber mesh drum to move to a specified position.

The automatic mesh stapling mechanism of the mesh stapler includes a mesh stapling support, a mesh receiving cylinder, a stapling head, a wire coil, a mesh stapling cylinder, a wire coil shaft and a sliding plate.

The mesh stapling cylinder, the wire coil shaft, the mesh receiving cylinder, the stapling head and the sliding plate are fixed on the mesh stapling support respectively. The wire coil can rotate freely on the wire coil shaft; the mesh stapling cylinder drives the stapling head to work, and the stapling head can cut a wire continuously and automatically to form nails in the form of staples. The nails are stapled on the fiber mesh drum driven by the sliding block of the electric servo cylinder to form a fiber mesh drum product. The fiber mesh drum product is sleeved on a piston rod of the mesh receiving cylinder, the cylinder piston rod retracts, and the fiber mesh drum product moves into a storage box outside the mesh reeling machine along the sliding plate.

The disclosure can realize mechanized production of a fiber filter screen and reduce manual labor.

In the figures, 1-manual fiber loading mesh disc mechanism, 2-quantitative fiber mesh conveying mechanism, 3-fiber mesh cutting mechanism, 4-automatic mesh reeling mechanism of left and right mesh reeling hands, 5-automatic fiber mesh drum delivery mechanism, 6-automatic mesh stapling mechanism of mesh stapler.

101-mesh disc support, 102-micro switch, 103-mesh disc, 104-guide wheel shaft, 105-guide wheel, 106-mesh pressing shaft, 107-mesh pressing rod, 108-mesh disc core, 109-mesh disc shaft, 110-mesh.

201-servo motor, 202-metering roll, 203-lower supporting wheel, 204-spring pin, 205-supporting wheel rack, 206-supporting wheel shaft, 207-servo motor support, 208-left guide plate, 209-right guide plate, 210-supporting plate.

301-blade, 302-cutter holder, 303-cutter cylinder, 304-cylinder seat.

401-mesh reeling mandrel, 402-left mesh reeling hand, 403-gear, 404-right mesh reeling hand, 405-gear, 406-pneumatic sliding table A, 407-pneumatic sliding table B, 408-mandrel seat, 409-rack A, 410-rack B, 411-mesh ejecting hand, 412-mesh ejecting cylinder.

501-discharge seat, 502-electric servo cylinder, 503-sliding table cylinder, 504-pneumatic parallel clamping jaw, 505-gripper.

601-mesh stapling support, 602-mesh receiving cylinder, 603-stapling head, 604-wire coil, 605-mesh stapling cylinder, 606-wire coil shaft, 607-sliding plate.

DETAILED DESCRIPTION

Figure 1:
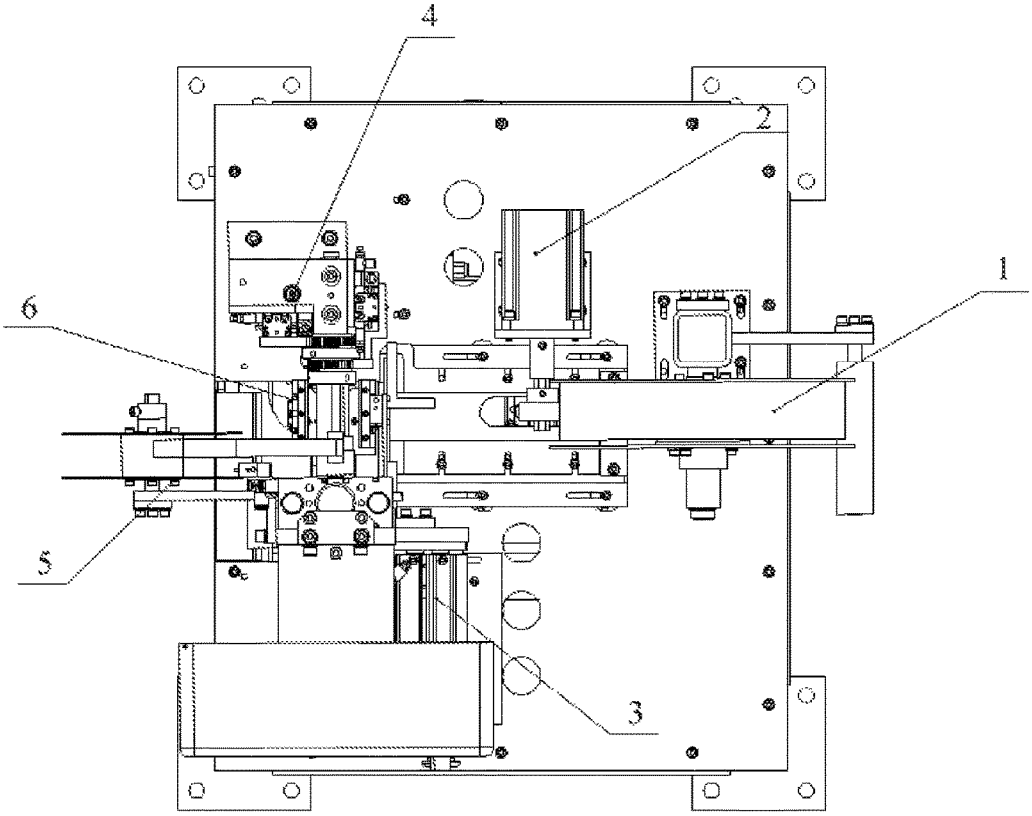
FIG. 1 is a top view of an automatic mesh reeling machine of the disclosure.

As shown in FIG. 1, an automatic mesh reeling machine includes a manual fiber loading mesh disc mechanism 1, a quantitative fiber mesh conveying mechanism 2, a fiber mesh cutting mechanism 3, an automatic mesh reeling mechanism 4 of left and right mesh reeling hands, an automatic fiber mesh drum delivery mechanism 5 and an automatic mesh stapling mechanism 6 of a mesh stapler.

Figure 2:
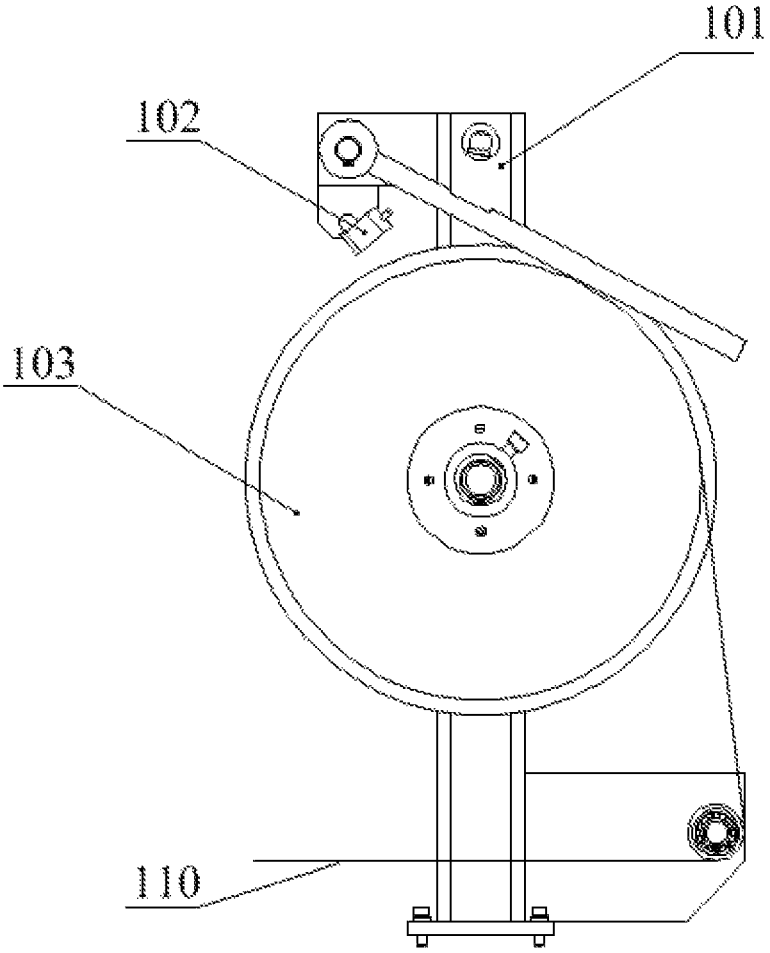
FIG. 2 is a schematic front view of a manual fiber loading mesh disc mechanism of the disclosure.
Figure 3:
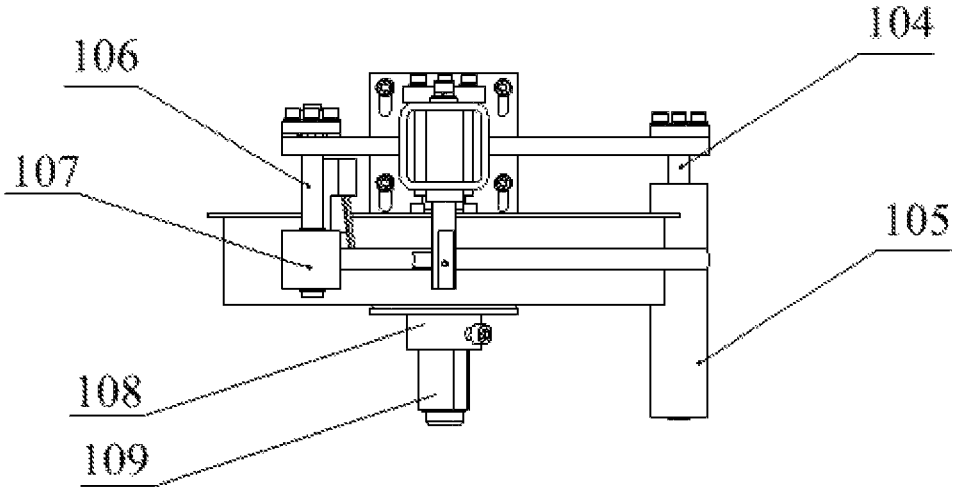
FIG. 3 is a schematic top view of the manual fiber loading mesh disc mechanism of the disclosure.

As shown in FIGS. 2 and 3, the manual fiber loading mesh disc mechanism 1 includes a mesh disc support 101, a micro switch 102, a mesh disc 103, a guide wheel shaft 104, a guide wheel 105, a mesh pressing shaft 106, a mesh pressing rod 107, a mesh disc core 108 and a mesh disc shaft 109.

The mesh pressing shaft 106, the mesh disc shaft 109, the guide wheel shaft 104 and the micro switch 102 are installed on the mesh disc support 101 respectively. The guide wheel 105 rotates freely around the guide wheel shaft 104; the mesh disc 103 is installed on the mesh disc core 108, and the mesh disc core 108 can rotate freely around the mesh disc shaft 109; and a mesh 110 goes round the guide wheel 105 and is conveyed to the quantitative fiber mesh conveying mechanism 2. One end of the mesh pressing rod 107 can rotate freely around the mesh pressing shaft 106, and the other end presses the mesh disc 103 to prevent the mesh from loosening. When the diameter of the mesh disc is reduced, the mesh pressing rod 107 swings clockwise, the mesh pressing rod 107 contacts the micro switch 102 in the absence of the mesh 110, and information about replacing the mesh disc 103 is transmitted via an electrical signal.

Figure 4:
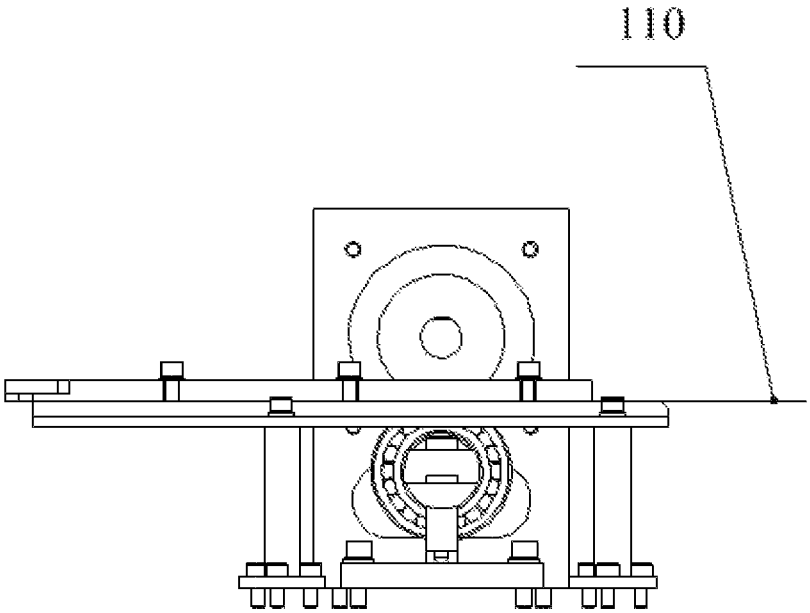
FIG. 4 is a schematic front view of a quantitative fiber mesh conveying mechanism of the disclosure.
Figure 5:
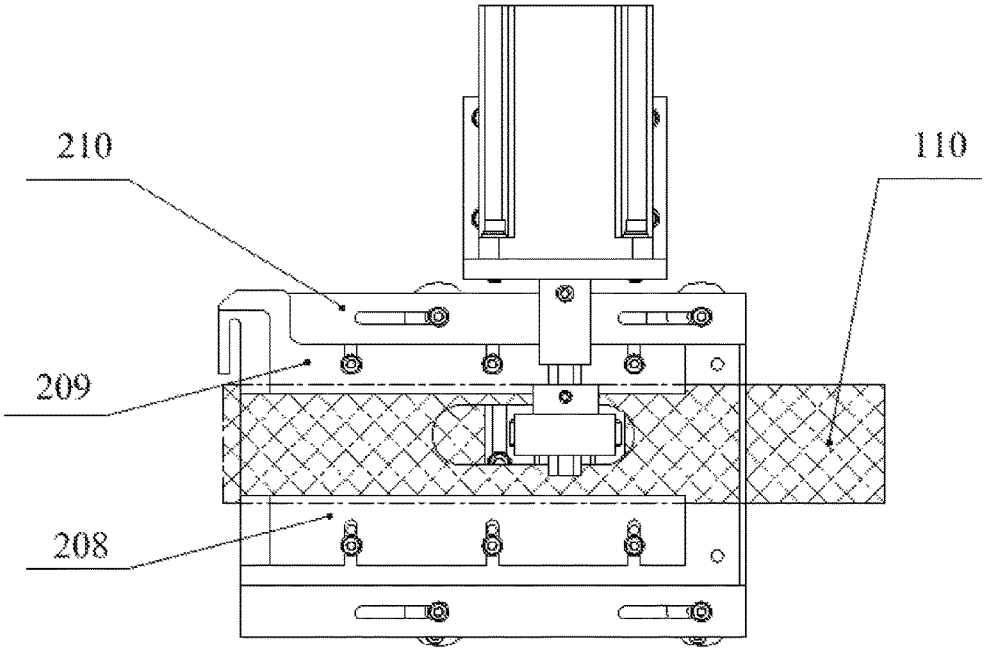
FIG. 5 is a schematic top view of the quantitative fiber mesh conveying mechanism of the disclosure.
Figure 6:
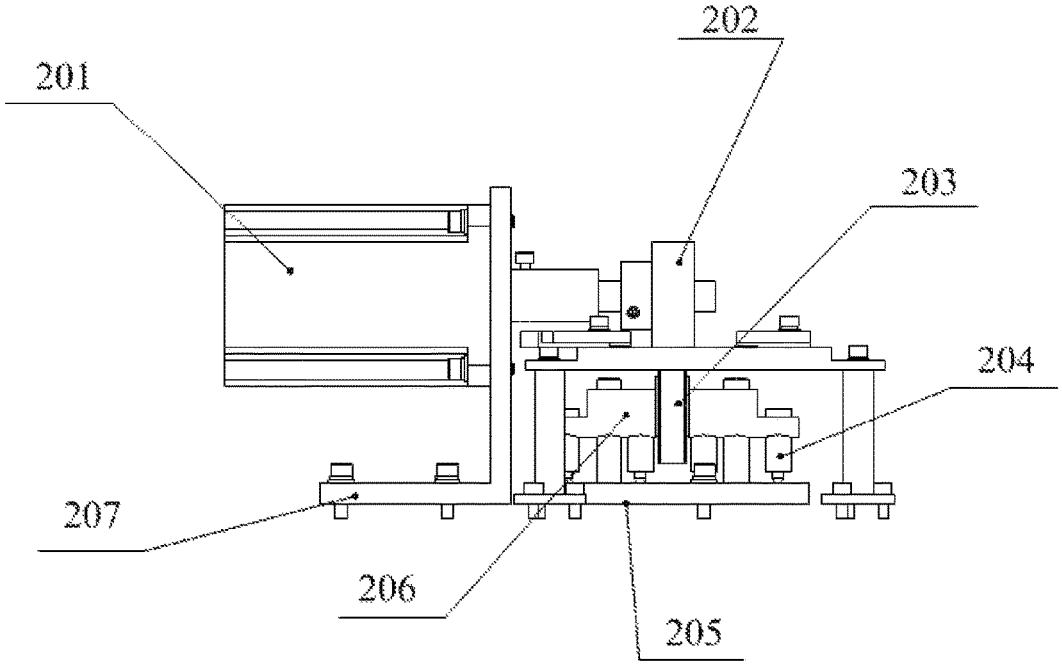
FIG. 6 is a schematic side view of the quantitative fiber mesh conveying mechanism of the disclosure.

As shown in FIGS. 4-6, the quantitative fiber mesh conveying mechanism 2 includes a servo motor 201, a metering roll 202, a lower supporting wheel 203, spring pins 204, a supporting wheel rack 205, a supporting wheel shaft 206, a servo motor support 207, a left guide plate 208, a right guide plate 209 and a supporting plate 210.

The servo motor 201 is connected with the metering roll 202 and the servo motor support 207; the lower supporting wheel 203, the spring pins 204, the supporting wheel shaft 206 and the supporting wheel rack 205 are connected with each other; the left guide plate 208 and the right guide plate 209 are connected with the supporting plate 210 respectively. The lower supporting wheel 203 moves up and down along the supporting wheel rack 205 under the action of elasticity of the spring pins 204; the mesh 110 penetrates through guide grooves below the left guide plate 208 and the right guide plate 209; the mesh 110 is sandwiched between the metering roll 202 and the lower supporting wheel 203; the metering roll 202 is driven by the servo motor 201 to rotate intermittently, and the rotating angle of the metering roll 202 is controlled electrically to realize fixed length feeding of the mesh 110.

Figure 7:
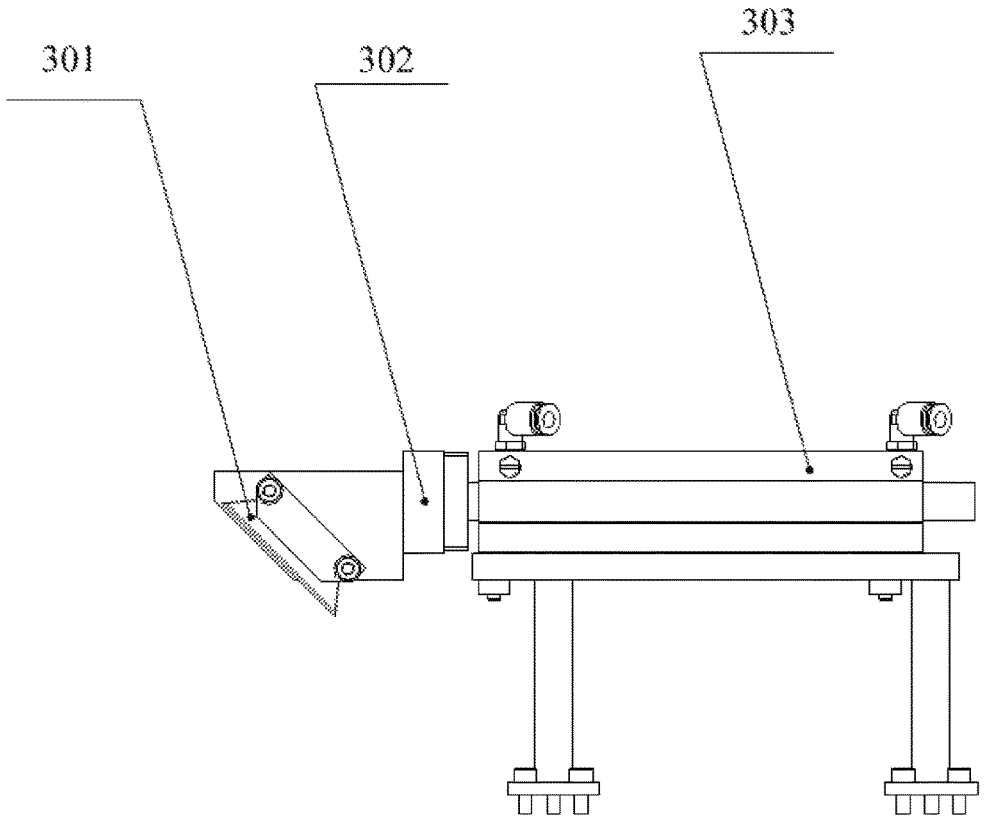
FIG. 7 is a schematic front view of a fiber mesh cutting mechanism of the disclosure.
Figure 8:
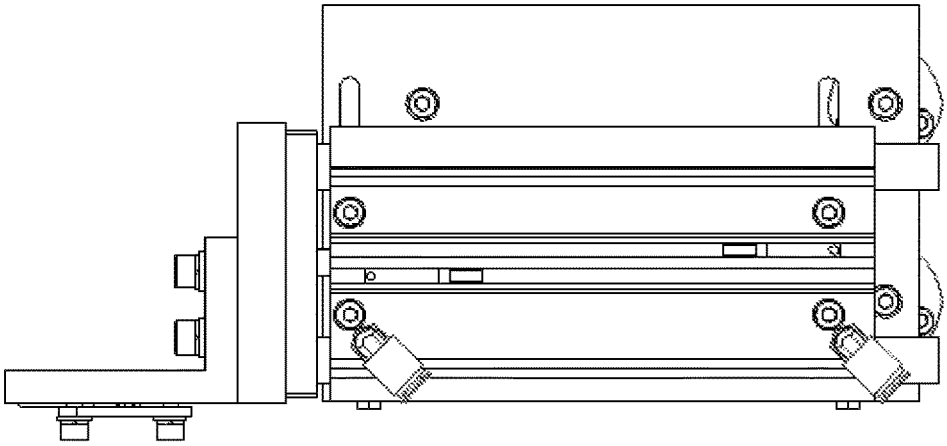
FIG. 8 is a schematic top view of the fiber mesh cutting mechanism of the disclosure.
Figure 9:
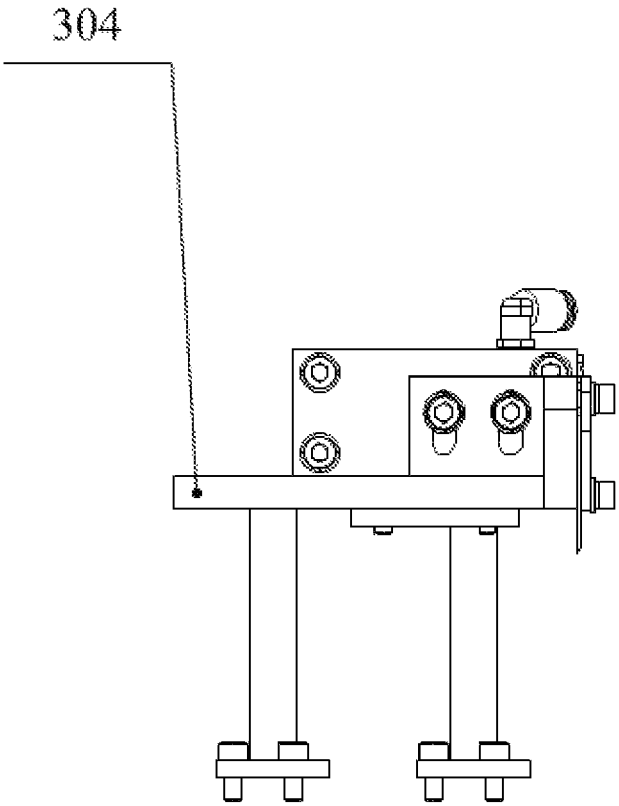
FIG. 9 is a schematic side view of the fiber mesh cutting mechanism of the disclosure.

As shown in FIGS. 7-9, the fiber mesh cutting mechanism 3 includes a blade 301, a cutter holder 302, a cutter cylinder 303 and a cylinder seat 304.

The blade 301 is fixed on the cutter holder 302; the cutter cylinder 303 is a standard cylinder with a guide rod, and the cutter holder 302 is fixed on a piston rod of the cutter cylinder 303; and the cutter cylinder 303 is connected with the cylinder seat 304. The blade 301 cuts the mesh 110 under the control of an electromagnetic valve of the cutter cylinder 303; and an operator adjusts the position of the cutter cylinder 303 on the cylinder seat 304 to reel the mesh having a required length.

Figure 10:
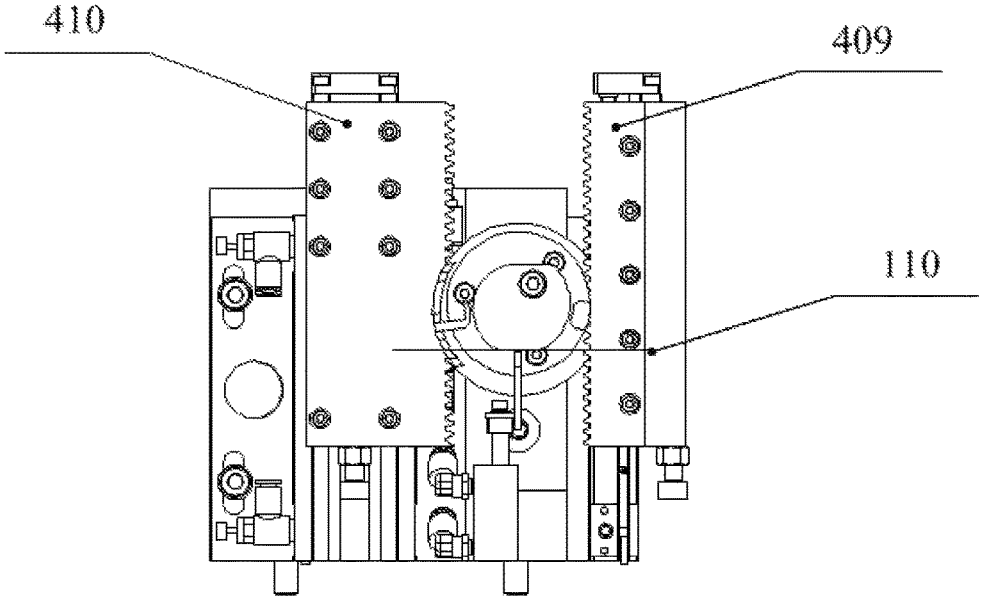
FIG. 10 is a schematic front view of an automatic mesh reeling mechanism of left and right mesh reeling hands of the disclosure.
Figure 11:
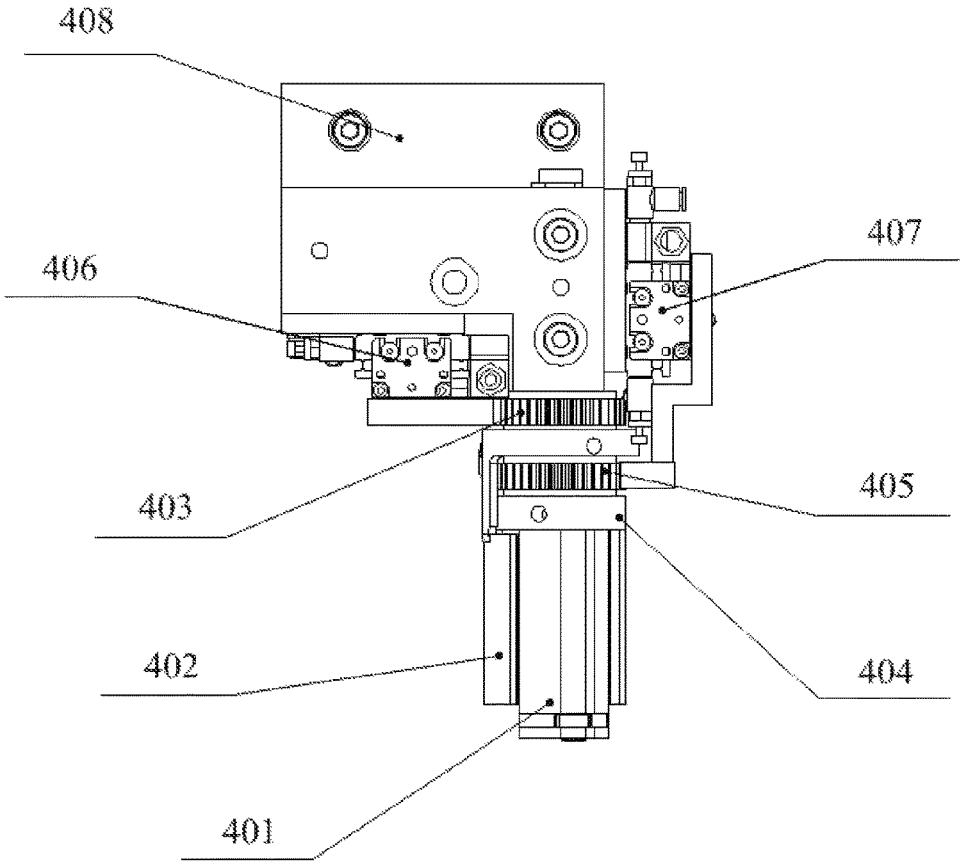
FIG. 11 is a schematic top view of the automatic mesh reeling mechanism of left and right mesh reeling hands of the disclosure.
Figure 12:
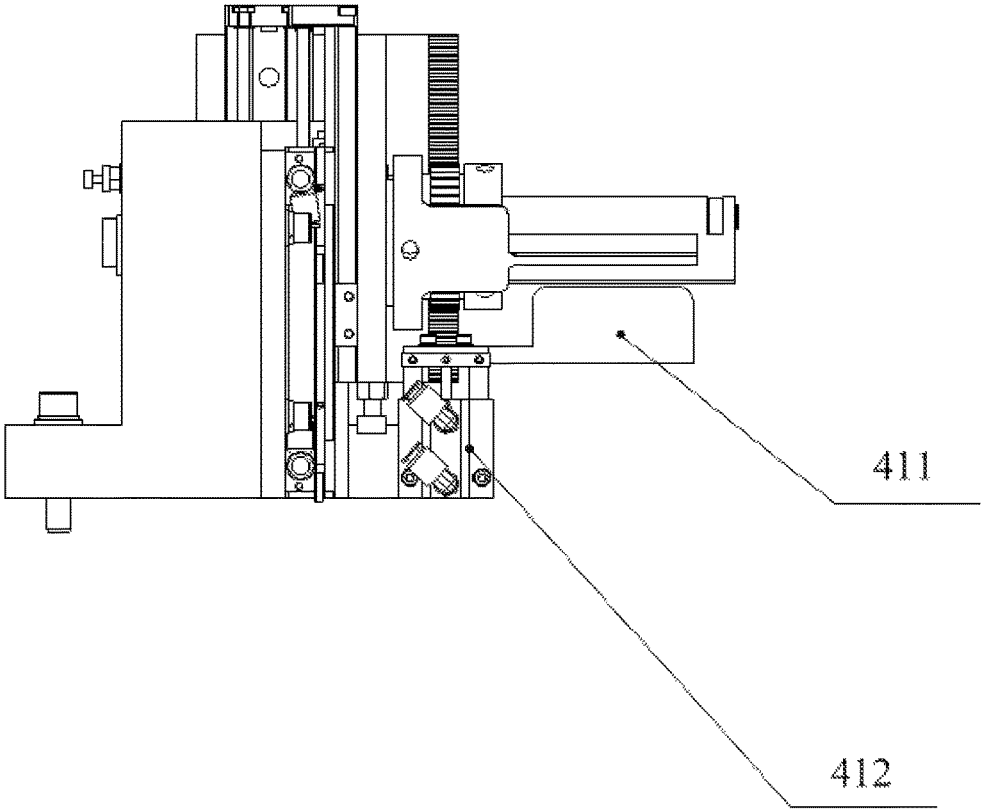
FIG. 12 is a schematic side view of the automatic mesh reeling mechanism of left and right mesh reeling hands of the disclosure.

As shown in FIGS. 10-12, the automatic mesh reeling mechanism 4 of left and right mesh reeling hands includes a mesh reeling mandrel 401, a left mesh reeling hand 402, a gear 403, a right mesh reeling hand 404, a gear 405, a pneumatic sliding table A 406, a pneumatic sliding table B 407, a mandrel seat 408, a rack A 409, a rack B 410, a mesh ejecting hand 411 and a mesh ejecting cylinder 412.

The mesh reeling mandrel 401, the pneumatic sliding table A 406, the pneumatic sliding table B 407 and the mesh ejecting cylinder 412 are fixed on the mandrel seat 408; the left mesh reeling hand 402, the right mesh reeling hand 404, the gear 403 and the gear 405 are sleeved on the mesh reeling mandrel 401. The mesh reeling mandrel 401 is a fixed shaft. The gear 403 is connected with the left mesh reeling hand 402, a piston of the pneumatic sliding table A 406 drives the rack B 410 to move up and down, and the up-down movement of the rack B 410 drives the gear 403 and the left mesh reeling hand 402 to rotate intermittently around the mesh reeling mandrel 401; the gear 405 is connected with the right mesh reeling hand 404, a piston of the pneumatic sliding table B 407 drives the rack A 409 to move up and down, and the up-down movement of the rack A 409 drives the gear 405 and the right mesh reeling hand 404 to rotate intermittently around the mesh reeling mandrel 401; and a piston of the mesh ejecting cylinder 412 drives the mesh ejecting hand 411 to move up and down.

The fixed length mesh conveyed by the quantitative conveying mechanism 2 stops between the mesh ejecting hand 411 and the mesh reeling mandrel 401, the left mesh reeling hand 402 reels the left mesh, the right mesh reeling hand 404 reels the right mesh, a mesh drum sleeved on the mesh reeling mandrel 401 is thus formed.

Figure 13:
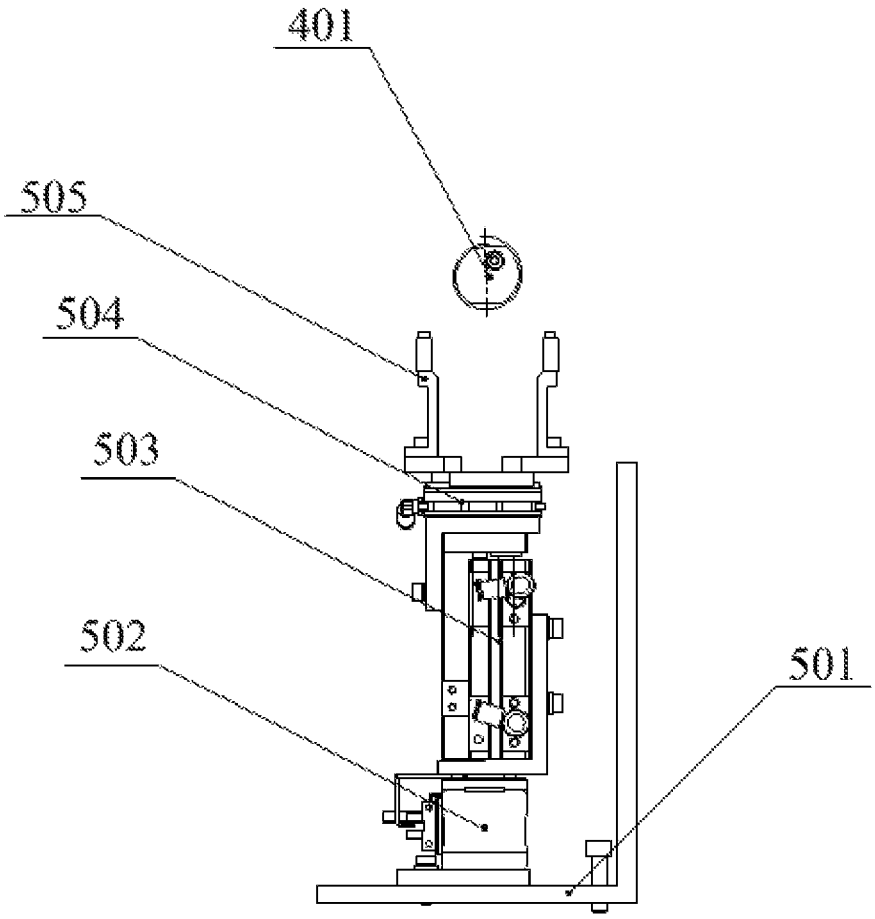
FIG. 13 is a schematic front view of an automatic fiber mesh drum delivery mechanism of the disclosure.
Figure 14:
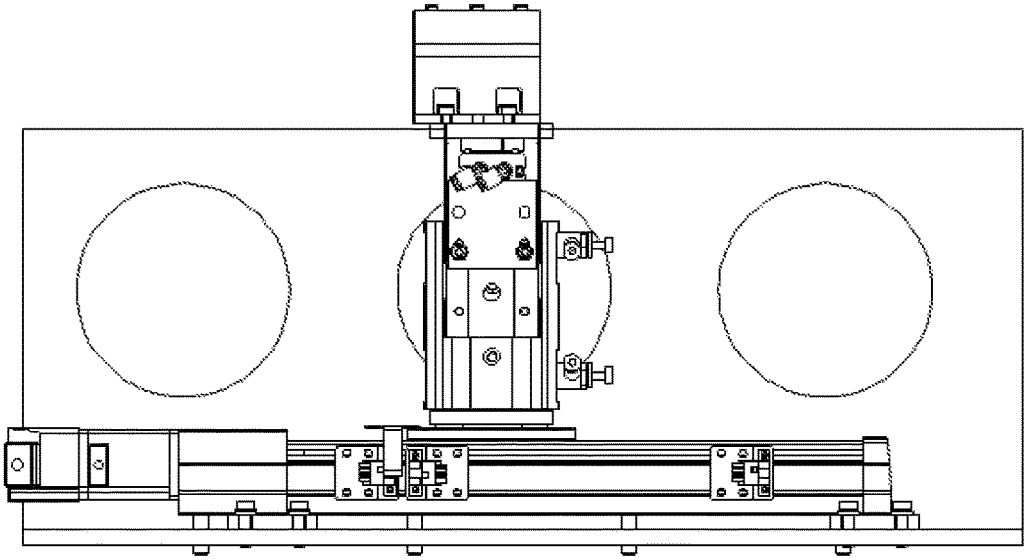
FIG. 14 is a schematic side view of the automatic fiber mesh drum delivery mechanism of the disclosure.

As shown in FIGS. 13 and 14, the automatic fiber mesh drum delivery mechanism 5 includes a discharge seat 501, an electric servo cylinder 502, a sliding table cylinder 503, pneumatic parallel clamping jaws 504 and grippers 505.

The electric servo cylinder 502 is fixed on the discharge seat 501, the sliding table cylinder 503 is fixed on a sliding block of the electric servo cylinder 502, the pneumatic parallel clamping jaws 504 are fixed on a piston of the sliding table cylinder 503, and the grippers 505 are fixed on a sliding block of the pneumatic parallel clamping jaws 504. When the pneumatic parallel clamping jaws 504 are opened, the lower position of the sliding table cylinder 503 is an original position of the automatic fiber mesh drum delivery mechanism.

When the automatic mesh reeling mechanism 4 reels out the mesh drum, the sliding table cylinder 503 moves to the upper position, the pneumatic parallel clamping jaws 504 are closed to clamp the fiber mesh drum, and the electric servo cylinder 502 simultaneously drives its sliding block carrying the fiber mesh drum to move to a specified position.

Figure 15:
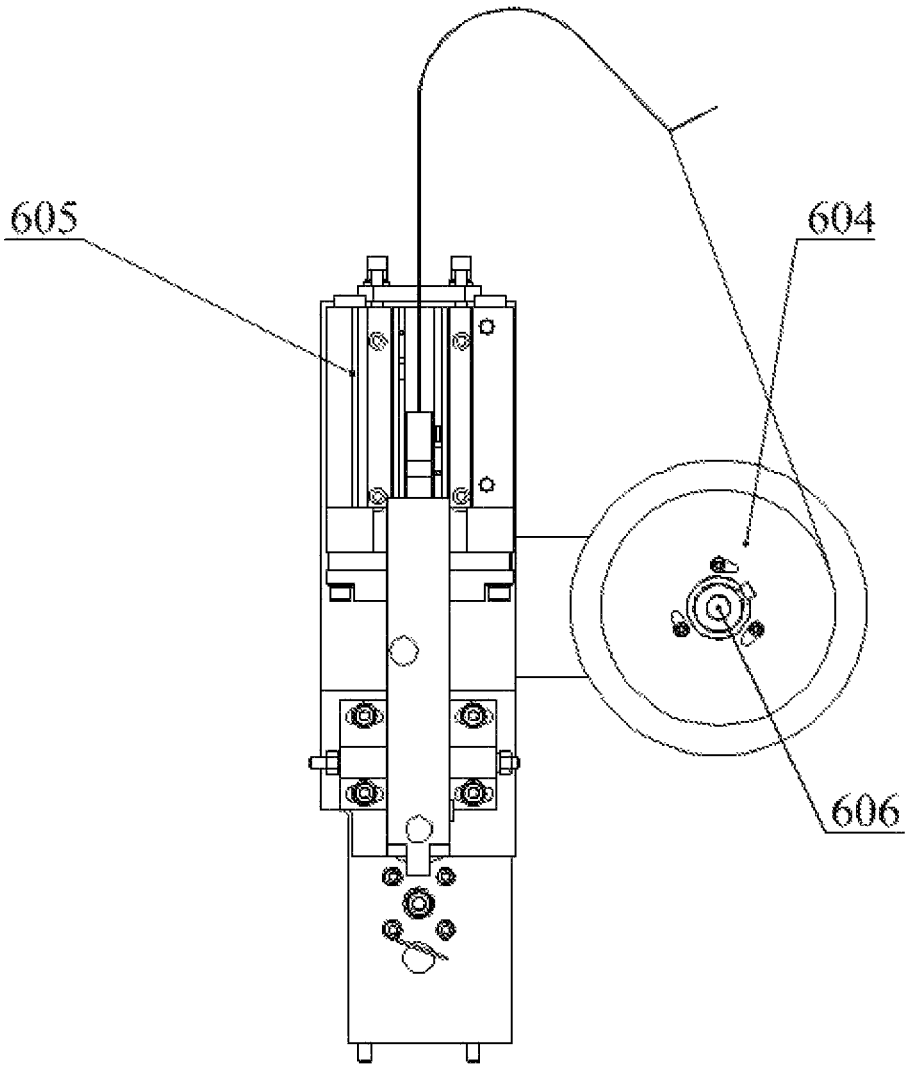
FIG. 15 is a schematic front view of an automatic mesh stapling mechanism of a mesh stapler of the disclosure.
Figure 16:
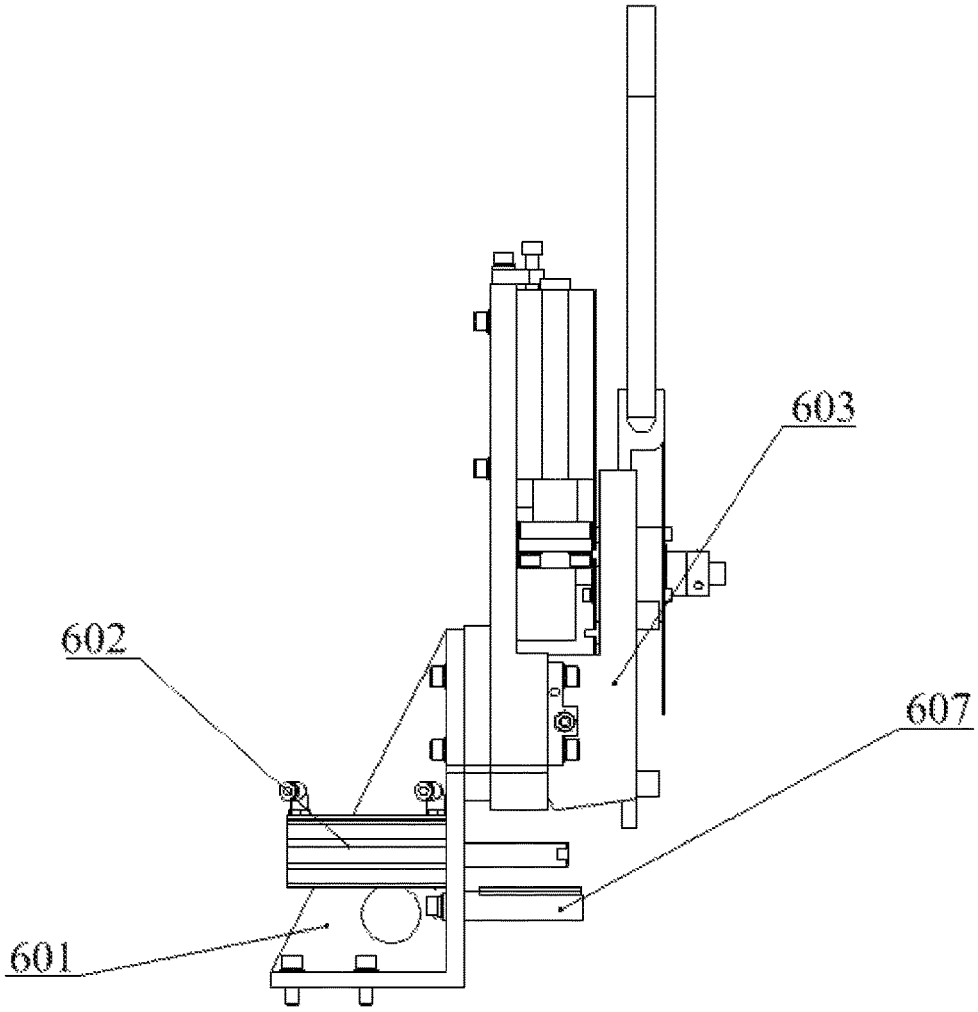
FIG. 16 is a schematic side view of the automatic mesh stapling mechanism of the mesh stapler of the disclosure.

As shown in FIGS. 15 and 16, the automatic mesh stapling mechanism 6 of the mesh stapler includes a mesh stapling support 601, a mesh receiving cylinder 602, a stapling head 603, a wire coil 604, a mesh stapling cylinder 605, a wire coil shaft 606 and a sliding plate 607.

The mesh stapling cylinder 605, the wire coil shaft 606, the mesh receiving cylinder 602, the stapling head 603 and the sliding plate 607 are fixed on the mesh stapling support 601 respectively. The wire coil 604 can rotate freely on the wire coil shaft 606; the mesh stapling cylinder 605 drives the stapling head 603 to work, and the stapling head 603 can cut a wire continuously and automatically to form nails in the form of staples. The nails are stapled on the fiber mesh drum driven by the sliding block of the electric servo cylinder 502 to form a fiber mesh drum product.

The fiber mesh drum product is sleeved on a piston rod of the mesh receiving cylinder 602, the piston rod of the cylinder 602 retracts, and the fiber mesh drum product moves into a storage box outside the mesh reeling machine along the sliding plate 607.

To sum up, the fiber mesh drum product made by the automatic mesh reeling machine is stable in quality and unified in specification. The automatic mesh reeling machine is convenient to operate, high in efficiency and strong in stability.

The invention claimed is:

1. An automatic mesh reeling machine, comprising a manual fiber loading mesh disc mechanism, a quantitative fiber mesh conveying mechanism, a fiber mesh cutting mechanism, an automatic mesh reeling mechanism of left and right mesh reeling hands, an automatic fiber mesh drum delivery mechanism and an automatic mesh stapling mechanism of a mesh stapler, wherein the manual fiber loading mesh disc mechanism comprises a mesh disc support, a micro switch, a mesh disc, a guide wheel shaft, a guide wheel, a mesh pressing shaft, a mesh pressing rod, a mesh disc core and a mesh disc shaft;

the mesh pressing shaft, the mesh disc shaft, the guide wheel shaft and the micro switch are installed on the mesh disc support respectively; the guide wheel rotates freely around the guide wheel shaft; the mesh disc is installed on the mesh disc core, and the mesh disc core can rotate freely around the mesh disc shaft; a mesh goes round the guide wheel and is conveyed to the quantitative fiber mesh conveying mechanism; one end of the mesh pressing rod can rotate freely around the mesh pressing shaft, and the other end presses the mesh disc to prevent the mesh from loosening; when the diameter of the mesh disc is reduced, the mesh pressing rod swings clockwise, the mesh pressing rod contacts the micro switch in the absence of the mesh, and information about replacing the mesh disc is transmitted via an electrical signal;

the quantitative fiber mesh conveying mechanism comprises a servo motor, a metering roll, a lower supporting wheel, spring pins, a supporting wheel rack, a supporting wheel shaft, a servo motor support, a left guide plate, a right guide plate and a supporting plate;

the servo motor is connected with the metering roll and the servo motor support; the lower supporting wheel, the spring pins, the supporting wheel shaft and the supporting wheel rack are connected with each other; the left guide plate and the right guide plate are connected with the supporting plate respectively; the lower supporting wheel moves up and down along the supporting wheel rack under the action of elasticity of the spring pins; the mesh penetrates through guide grooves below the left guide plate and the right guide plate; the mesh is sandwiched between the metering roll and the lower supporting wheel; the metering roll is driven by the servo motor to rotate intermittently, and the rotating angle of the metering roll is controlled electrically to realize fixed length feeding of the mesh;

the fiber mesh cutting mechanism comprises a blade, a cutter holder, a cutter cylinder and a cylinder seat;

the blade is fixed on the cutter holder; the cutter cylinder is a standard cylinder with a guide rod, and the cutter holder is fixed on a piston rod of the cutter cylinder; and the cutter cylinder is connected with the cylinder seat; the blade cuts the mesh under the control of an electromagnetic valve of the cutter cylinder;

the automatic mesh reeling mechanism of left and right mesh reeling hands comprises a mesh reeling mandrel, a left mesh reeling hand, a gear, a right mesh reeling hand, a gear, a pneumatic sliding table A, a pneumatic sliding table B, a mandrel seat, a rack A, a rack B, a mesh ejecting hand and a mesh ejecting cylinder;

the mesh reeling mandrel, the pneumatic sliding table A, the pneumatic sliding table B and the mesh ejecting cylinder are fixed on the mandrel seat; the left mesh reeling hand, the right mesh reeling hand, the gear and the gear are sleeved on the mesh reeling mandrel; the mesh reeling mandrel is a fixed shaft; the gear is connected with the left mesh reeling hand, a piston of the pneumatic sliding table A drives the rack B to move up and down, and the up-down movement of the rack B drives the gear and the left mesh reeling hand to rotate intermittently around the mesh reeling mandrel; the gear is connected with the right mesh reeling hand, a piston of the pneumatic sliding table B drives the rack A to move up and down, and the up-down movement of the rack A drives the gear and the right mesh reeling hand to rotate intermittently around the mesh reeling mandrel; a piston of the mesh ejecting cylinder drives the mesh ejecting hand to move up and down;

the fixed length mesh conveyed by the quantitative conveying mechanism stops between the mesh ejecting hand and the mesh reeling mandrel, the left mesh reeling hand reels the left mesh, the right mesh reeling hand reels the right mesh, a mesh drum sleeved on the mesh reeling mandrel is thus formed;

the automatic fiber mesh drum delivery mechanism comprises a discharge seat, an electric servo cylinder, a sliding table cylinder, pneumatic parallel clamping jaws and grippers;

the electric servo cylinder is fixed on the discharge seat, the sliding table cylinder is fixed on a sliding block of the electric servo cylinder, the pneumatic parallel clamping jaws are fixed on a piston of the sliding table cylinder, and the grippers are fixed on a sliding block of the pneumatic parallel clamping jaws;

the automatic mesh stapling mechanism of the mesh stapler comprises a mesh stapling support, a mesh receiving cylinder, a stapling head, a wire coil, a mesh stapling cylinder, a wire coil shaft and a sliding plate;

the mesh stapling cylinder, the wire coil shaft, the mesh receiving cylinder, the stapling head and the sliding plate are fixed on the mesh stapling support respectively; the wire coil can rotate freely on the wire coil shaft; the mesh stapling cylinder drives the stapling head to work, and the stapling head can cut a wire continuously and automatically to form nails in the form of staples; the nails are stapled on the fiber mesh drum driven by the sliding block of the electric servo cylinder to form a fiber mesh drum product;

the fiber mesh drum product is sleeved on a piston rod of the mesh receiving cylinder, the piston rod of the cylinder retracts, and the fiber mesh drum product moves into a storage box outside the mesh reeling machine along the sliding plate.

* * * * *